US005192838A

United States Patent [19]

Breed et al.

[11] Patent Number: 5,192,838

[45] Date of Patent: Mar. 9, 1993

[54] FRONTAL IMPACT CRUSH ZONE CRASH SENSORS

[75] Inventors: David S. Breed, 270 Hillcrest Rd., Boonton Township, Morris County, N.J. 07005; Anthony S. Pruszenski, Jr., Plum Island, Mass.

[73] Assignee: David S. Breed, Boonton Township, Morris County, N.J.

[21] Appl. No.: 480,257

[22] Filed: Feb. 15, 1990

[51] Int. Cl.[5] ..... H01H 35/14

[52] U.S. Cl. ..... 200/61.45 R; 200/61.48

[58] Field of Search ..... 200/61.45 R, 61.45 M, 200/61.48-61.53; 280/730-735

[56] References Cited

U.S. PATENT DOCUMENTS

| | | | |
|---|---|---|---|
| 3,848,695 | 11/1974 | Lacaze, Jr. | 280/735 |
| 3,974,350 | 8/1976 | Breed | 200/61.53 |
| 4,028,516 | 6/1977 | Hirashima et al. | 200/61.45 M |
| 4,201,898 | 5/1980 | Jones et al. | 200/61.45 R |
| 4,249,046 | 2/1981 | Livers et al. | 200/61.45 R |
| 4,262,177 | 4/1981 | Paxton et al. | 200/61.45 R |
| 4,321,438 | 3/1982 | Emenegger | 200/61.45 R |
| 4,329,549 | 5/1982 | Breed | 200/61.45 M |
| 4,362,913 | 12/1982 | Kumita et al. | 200/61.45 R |
| 4,816,627 | 3/1989 | Janotik | 200/61.45 M |
| 4,900,880 | 2/1990 | Breed | 200/61.45 M |
| 4,902,861 | 2/1990 | Cook | 200/61.48 |
| 4,932,260 | 6/1990 | Norton | 73/517 R |
| 4,966,388 | 10/1990 | Warner et al. | 280/730 |

*Primary Examiner*—J. R. Scott

*Attorney, Agent, or Firm*—Sprung Horn Kramer & Woods

[57] ABSTRACT

This invention includes crash sensors designed to be used for frontal impact sensing and the strategies of using these sensors. It is analyzed and shown that velocity sensing or damped sensors are desirable for frontal impact sensing. Inertially damped sensors, with a damping force proportional to the square to velocity, is most appropriate. Such sensors can be made of plastic and in the shape of short round or rectangular cylinders. The particular shape the these sensors minimizes the chance that the sensors will be rotated during the crash. It is further concluded that these sensors should be installed on the frontal radiator structure or at such similar location near the front of the vehicle. A typical crash sensor includes a hinged plastic mass attached to the housing. The mass activates a contact assembly after a predetermined movement of the mass. The gap existing between the movable mass and the interior wall of the housing enhances the damping function of the crash sensor.

14 Claims, 13 Drawing Sheets

FRONTAL IMPACT CRUSH ZONE CRASH SENSORS

CROSS REFERENCE

This application is related to application Ser. No. 07/480,273, filed concurrently with this application, for "Side Impact Sensors", which is a continuation-in-part of abandoned application Ser. No. 314,603 filed Feb. 23, 1989 "Side Impact Sensors".

This application is also related to application Ser. No. 07,480,271, filed concurrently with this application, for Improved Passenger Compartment Crash Sensors.

BACKGROUND OF THE INVENTION

Air bag passive restraint systems for protecting automobile and truck occupants in frontal collisions are beginning to be adopted by most of the world's automobile manufacturers. It has been estimated that by the mid-1990's all new cars and trucks manufactured will have air bag passive restraint systems. These air bag systems are designed to protect occupants in frontal impacts.

Many types of crash sensors have been proposed and several different technologies are now in use for determining if a crash is severe enough to require the deployment of a passive restraint system such as an air bag or seatbelt tensioner. Three types of sensors, in particular have been widely used to sense and initiate deployment of an air bag passive restraint system. These sensors include an air damped ball-in-tube sensor such as disclosed in Breed U.S. Pat. Nos. 3,974,350, 4,198,864, 4,284,863, 4,329,549 and 4,573,706, a spring mass sensor such as disclosed in Bell U.S. Pat. Nos. 4,116,132, 4,167,276 and an electronic sensor such as is part of the Mercedes air bag system. In addition, a crush sensing switch has been proposed which discriminates between air bag desired crashes and those where an air bag is not needed based on the crush of the vehicle as disclosed in Breed U.S. Pat. No. 4,900,880. The subject of this invention is a new sensor which has some advantages over the prior art for some applications. This invention is related to copending applications Ser. Nos. 07/480,273 and 07/480.271 filed on even date.

The choice of the sensor technology to be used on a given vehicle depends on where the sensor is mounted. When a car is crashing only certain portions of the vehicle are crushing at the time that the sensors must trigger to initiate timely restraint deployment. A car, therefore, can be divided into two zones: the crush zone, usually about the first 12 inches from the front of the vehicle, which has changed its velocity substantially relative to the remainder of the vehicle and the non-crush zone which is still travelling at close to the pre-crash velocity. To sense a crash properly in the crush zone the sensors must function as a velocity change indicator; that is, the sensor must trigger at approximately a constant velocity change regardless of the shape or duration of the crash pulse. This invention is concerned with frontal crush zone sensors only, and ones that trigger on a constant velocity change for some implementations and where the velocity change function is tailorable for other implementations.

Air damped ball-in-tube crash sensors are inherently velocity change indicators and are the only sensors which have found widespread use for mounting in the crush zone. Spring mass sensors inherently trigger at smaller velocity changes for high deceleration levels and high velocity changes for low deceleration levels and therefore have only found widespread applicability in the non-crush zone locations of the car. Electronic sensors could be designed to function in either manner and thus could be placed either in the crush zone or in the non-crush zone. Although, the preferred implementation of this invention uses air damping, other implementations are undamped spring mass and electronic sensors Each of these sensors has significant limitations. If spring mass sensors are placed in the crush zone they will either trigger on very short duration low velocity change crush pulses where a restraint system is not needed or they will not trigger on longer duration pulses where a restraint is needed, depending on the particular sensor design and particular mounting location. In addition, since the motion of the mass in the spring mass system is undamped, it has been very difficult to get reliable contact closure on vigorous crash pulses where the mass bounces back and forth many times. To solve this contact problem, spring mass sensors are frequently placed slightly out of the crush zone for frontal barrier impacts. In this case, however, they sometimes become in the crush zone, for example in angle car to car impacts, and are prone to both triggering when a restraint is not desired and to the contact problems discussed triggering when a restraint is not desired and to the contact problems discussed above.

Electronic crash sensors have so far only been used in protected passenger compartment non-crush zone locations. Most electronic sensors have environmental limitations which are exceeded by crush zone locations which are frequently near the engine or radiator. Newer electronic technologies, however, have overcome these environmental limitations and consideration can now be given to crush zone mounted electronic sensors.

The ball-in-tube sensor triggers properly only when responding to longitudinal decelerations. When cross axis accelerations in the vertical and lateral directions are present, the ball can begin whirling or orbiting around inside the cylinder resulting in a significant change in the response of the sensor.

The ball-in-tube sensor depends upon the viscous flow of air between the ball and the tube to determine the characteristics of the sensor. The viscosity of air is a function of temperature and, although materials are selected for the ball and the tube to compensate for the viscosity change, this compensation is not complete and thus the characteristics of the ball-in-tube sensor will inherently vary with temperature. Certain implementations of this invention use viscous air flow and have the same limitations.

In addition, the biasing force which is used to hold the ball at its home position when a vehicle is not in a crash is provided by a ceramic magnet for the ball-in-tube crush zone sensor. This biasing force has a significant effect on the threshold triggering level for long duration pulses such as impacts into snow banks or crash attenuators which frequently surround dangerous objects along the highways. Due to the temperature effects on the magnet, this biasing force changes by about 40% over the desired temperature operating range of the occupant restraint system. Most implementations of the present invention use a spring for the bias thus eliminating this problem.

To function properly, a crush zone sensor of any design must be in the crush zone. Any crush zone sensor which is based on a mass sensing deceleration has a potential of triggering very late if it is not in the crush zone for a particular crash. This is particularly a problem with ball-in-tube sensors which have a very low bias. One example of this involved a stiff vehicle in a low speed barrier impact where the sensor was not sufficiently forward in the car and thus not in the crush zone. The sensor triggered when the entire velocity change of the car reached 10 MPH at which time the occupant was leaning against the air bag. An occupant who is severely out of position and close to the air bag when it deploys can be seriously injured by the deploying air bag. It is therefore important that at least one sensor be in the crush zone for all air bag desired crashes and that all crush zone sensors have sufficient bias to prevent late firing for low velocity long duration pulses. Sensors designed according to the teachings of this invention, generally have a high enough bias that late according to the teachings of this invention, generally have a high enough bias that late triggering is not a problem.

The ball-in-tube sensor is both expensive and subject to wide manufacturing tolerances. This is partially due to the small clearance which exists between the ball and tube. Since this clearance acts as the restrictor to fluid flow, it determines the calibration of the sensor. It therefore must be very carefully controlled. The tolerance on this clearance is typically on the order of 0.000050 inches which requires expensive machining and gaging manufacturing processes. Because of the difficulty in maintaining these tolerances and in particular the tolerance on the roundness of the cylinder, sensors exhibit a manufacturing calibration range of more than 20%!

All crush zone sensors are caused to trigger by being impacted by crushed material moving rearward as the vehicle crushes progressively during a crash. The geometry of this crushed material can vary from vehicle to vehicle and from crash to crash. If a sensor has a shape which causes it to project outward from its support in a cantilever fashion, it is prone to be rotated as it is impacted by the crushed material. In some cases, this rotation can be so severe as to prevent the sensor from triggering since the sensor is no longer pointed forward. A study of crushed vehicles form real life crashes has shown that rotation of the sensor mounting locations is frequently severe. If instead, the sensor has a flat shape with the thickness in the sensing direction small compared with the width and height of the sensor, the local shape of the crushed material impacting the sensor will have a smaller effect, the sensor will have a better support against rotation and the sensor will tend to align itself with the have a better support against rotation and the sensor will tend to align itself with the direction of force thus increasing the probability of properly sensing the crash.

The present invention seeks to eliminate the drawbacks of these other crush zone sensors as explained below.

SUMMARY OF THE INVENTION

To satisfy the various requirements for a frontal impact crush zone sensor having an inertial mass, it is concluded that damping of the motion of the mass is desirable; if the clearance between the mass and housing is used as the restrictor, it should be made as large as possible to permit the largest tolerances on the mass and housing dimensions; inertial flow damping is preferable since it is less effected by the clearance and temperature; and the sensor should have a flat shape to minimize the chance of sensor rotation from impacts with crushed material. It is also disclosed that at least two sensors, one on either side is most desirable for frontal impact sensing to maximize the chance that one will be in the crush zone during the crash. Some large cars may need an additional center mounted sensor. Finally, the sensor design must minimize environmental effects such as temperature and cross axis vibration.

It is a principal object of this invention to provide a crash sensor having an inertial mass for use with a frontal impact protection apparatus which avoids the limitations It is a principal object of this invention to provide a crash sensor having an inertial mass for use with a frontal impact protection apparatus which avoids the limitations of the prior art.

It is another object of this invention to provide a sensing device, for use with a frontal impact restraint system, which minimizes the risk of inadvertent actuation.

It is an additional object of this invention to provide an easily manufacturable sensor, with lose dimensional tolerances and which is inexpensive to make.

It is another object of this invention to provide a inertial flow sealed crash sensor, which maintains a constant gas density and thus is minimally affected by temperature changes.

It is a further object of this invention to provide a crash sensor, which is insensitive to the variations of ambient temperature.

It is a further object of this invention to provide a sensor with a flat shape which is resistant to rotation during the sensing portion of a crash.

It is yet another object of this invention to provide a sensor with is not significantly effected by cross axis accelerations.

It is another object of this invention to provide a sensor which can be easily manufactured to tight calibration tolerances.

Yet another object of this invention to provide a crush zone sensor which is testable.

Other objects and advantages of this invention will become apparent from the disclosure which follows.

DETAILED DESCRIPTIONS OF PREFERRED EMBODIMENTS

Figure 1:
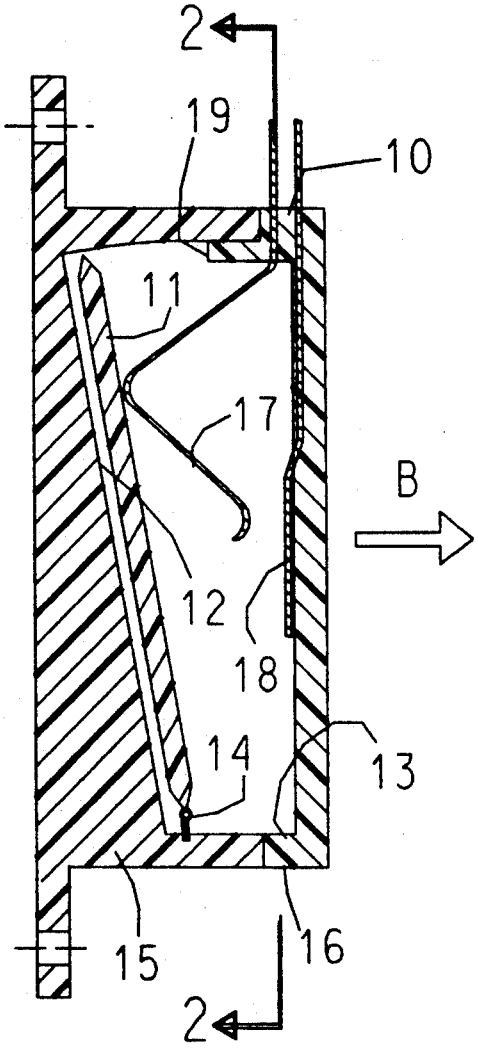
FIG. 1 is a transverse cross sectional view of a square plastic frontal crush zone sensor containing an integral molded hinge.

One preferred embodiment of this invention is manufactured as a thin square or rectangular housing with a width slightly larger then 2 inches, and a thickness of 0.5 to 0.75 inch. FIG. 1 is a cross sectional view of such a frontal crush zone sensor 10. A member or flapper 11, initially resting on an inclined surface 12, is hinged to the inside surface of the housing 13 by a plastic or metal hinge 14. The housing comprises a left casing 15 and a right casing 16. A first contact 17, attached to housing 13, biases the flapper 11 toward its initial position. A second contact 18 is also fixed to the housing 13. When installed on a vehicle for frontal impact sensing, the right side of the sensor faces forward in the direction of the arrow B.

Figure 2:
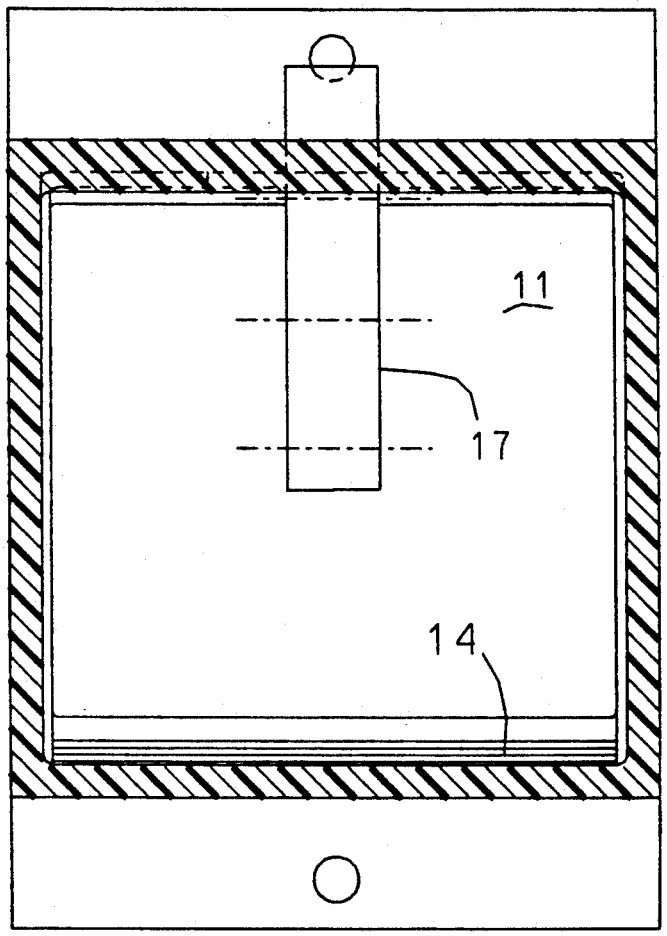
FIG. 2 is a cross sectional view taken along lines 2—2 of FIG. 1.

FIG. 2 is a view of the sensor of FIG. 1 taken along lines 2—2 of FIG. 1.

When the sensor is subjected to a crash pulse of enough magnitude and duration, the flapper 11 moves toward contact 18. After a specified travel, the first contact 17 makes contact with 18 and closes an electrical circuit to initiate deployment of the protection apparatus associated with the sensing system. The first contact is flexible and allowed to deflect further beyond the triggering position. Therefore, the flapper can travel over and beyond the triggering position until it is stopped by the wall 19 of the housing. This over travel is necessary in order to provide a long contact duration or dwell. If the acceleration of the crash pulse drops below the bias level later in the crash, then the flapper moves back toward its initial position under the biasing force of contact 17.

Flapper 11 and the left housing casing 15 can be produced as a single plastic piece by injection molding. The flapper and the housing are attached by a plastic hinge formed in the manufacturing process or by a metal, plastic or other material hinge insert molded during the molding process. A candidate for the plastic material with well known hinge properties is polypropylene, which is strong and durable enough to provide a flexible bonding between the flapper and the housing. Since it is difficult to maintain tolerances in unreinforced polypropylene, other plastics would be more suitable for some applications.

The right side of the housing 16 is also to be made of plastic and formed by injection molding, while the contacts 17 and 18 are made of conductive metals and can be inserted into the plastic part in the molding process, thereby combined into a single piece to be assembled with the left side of the sensor. The assembly of the sensor is completed by combining the two parts of the housing by heat sealing, ultrasonic sealing, through use of a compression sealing ring (not shown) or other suitable sealing method. With the appropriate metal-plastic adhesive coating on the metal pieces, one suitable coating material is disclosed in U.S. Pat. No. 3,522,575 of Watson et al the metal parts and the plastic can be bonded within the range of the operating temperature of a sensor. This manufacturing technique hermetically seals the sensor assuring that the gas density remains constant and prevents moisture and dust from entering the sensor.

A major difference between the sensor disclosed in this invention and a typical ball-in-tube sensor is the damping effect provided by the gas flow. The gas flow in this embodiment of this invention is of the inertial type. Therefore, the resisting force caused by the pressure difference is proportional to the second power of the gas velocity. Viscous damping utilized in ball-in-tube sensors, on the other hand, is linearly proportional to the gas flow velocity. Inertial type damping is not dependent on the viscosity but instead on the mass flow of the gas and therefore is insensitive to temperature changes, assuming that the sensor is sealed and gas density is therefore kept constant.

The motion of the flapper is determined by the bias, the pressure force, and the inertial force caused by the crash pulse. The size of the flapper of the preferred embodiment can be in the range of 1.5 to 3 inches, which is much larger than the diameter of other known crash sensors. This large size has two significant advantages. First, the clearance between the flapper and the housing becomes large in comparison to conventional ball-in-tube sensors, for example. Thus the tolerance on this clearance is also sufficiently large as to permit the parts to be molded from plastic. Furthermore, if both parts are molded simultaneously in the same mold, this clearance can be held quite accurately. Also, for inertial flow, the resistance to gas flow is proportional to the first power of the clearance while for viscous flow, it is proportional to either the third power (for a cylindrical piston) or the 2.5 power (for a spherical piston). This further reduces the effect of manufacturing variations on the clearance and improves the accuracy of the sensor.

A computer program simulating the motion of the flapper inside the housing is used to analyze the sensor performance. One example of a sensor with rectangular disk as described in FIG. 8-9 has the following parameters:

| | |
|---|---|
| mass (disk) | = 3 grams |
| disk height | = 1.5 inches |
| disk width | = 2.5 inches |
| clearance | = 0.010 inches |
| initial disk position | = −10 degrees (counter clockwise from vertical position) |
| triggering position | = −5 degrees (counter clockwise from vertical position) |
| disk travel limit | = +12 degrees (clockwise from vertical position) |
| initial bias | = 1.0 G's |
| average bias | = 8.0 G's |

Simulation of the sensor is conducted using haversine pulses of different duration. The sensor with the above parameters is found to marginally trigger at:

| PULSE DURATION (MS) | VELOCITY CHANGE (MPH) |
|---|---|
| 10 | 11.4 |

-continued

| PULSE DURATION (MS) | VELOCITY CHANGE (MPH) |
|---|---|
| 15 | 9.7 |
| 20 | 9.2 |
| 25 | 9.1 |
| 30 | 9.3 |
| 35 | 9.5 |
| 40 | 9.8 |
| 45 | 10.4 |
| 50 | 10.8 |

Since this sensor has a marginal velocity change of 9-11 MPH in the range of 10-30 milliseconds, it is a candidate for a crush zone sensor since signals received in the crush zone usually possess a rapid velocity change within 10-30 milliseconds, and a velocity change of 10 MPH is commonly accepted as a threshold for critical injuries. Depending the crash responses of a vehicle and the mounting location of the sensor, the parameters of the sensor, such as clearance and bias, can be adjusted to fit the desired specifications.

Although not shown in the drawings, the sensors of this invention can contain a mechanism for adjusting the initial position of the flapper to compensate for the remaining tolerances. For all of the above reasons, a sensor which is considerably more accurate than currently available mechanical crash sensor, results. Furthermore, the large width and thin shape of the preferred sensors is well adapted for sensing frontal impacts in the crush zone since the tendency will be for the sensor to align itself such that the principle direction of force is parallel to the axis of the flapper. A small sensor, for example, might rotate so as to place its sensitive axis in a direction substantially different from the principle direction of force. Width herein refers to the maximum horizontal dimension of the sensor and height refers to the maximum vertical dimension of the sensor.

This ability to make the sensor entirely from plastic (with the exception of the contacts) makes this sensor quite easy to manufacture and very inexpensive to produce.

In an inertially damped sensor, the velocity change required to trigger the sensor depends on the duration of the crash pulse. This sensor in general requires a larger velocity change to trigger for short duration pulses than for long duration pulses. However, this effect can be tailored by controlling the initial air volume behind the flapper. Since air is compressible, some motion of the mass is required before a pressure drop associated with a given level of acceleration is achieved. Thus the pressure behind the flapper drops, the gas expands and the initial motion of the flapper is substantially undamped. The magnitude of this effect depends on the amount of gas trapped behind the flapper.

Figure 10:
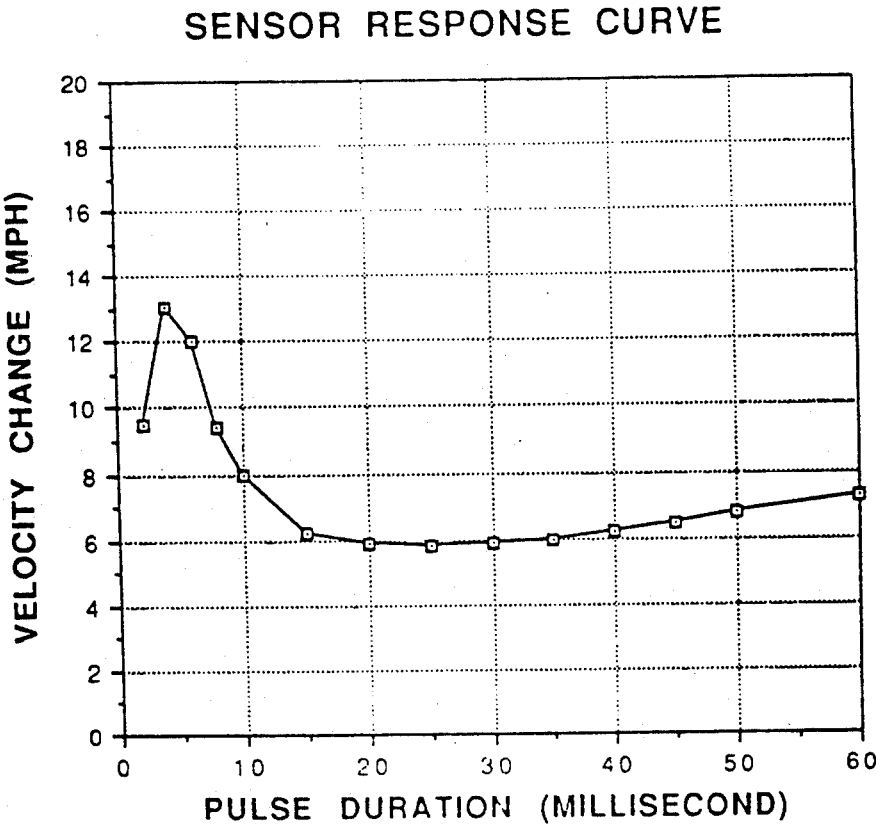
FIG. 10 is a typical response curve of a preferred embodiment of the invention using inertial gas flow.

The bias is used to adjust the sensitivity of the sensor to long duration pulses. A typical response curve is shown in FIG. 10 for an inertially damped sensor. The curve shows the marginal trigger/no-trigger response to a haversine acceleration input pulse having varying durations (horizontal axis) and varying velocity changes (vertical axis). The sensor will trigger for all pulses having a velocity change above the curve and not trigger for all velocity change pulse duration combinations lying below the curve. By adjusting the size of the clearance, the mass of the flapper, the initial air volume behind the flapper and the bias, the sensor response curve can thus be tailored to achieve a wide variety of response curves and thus matched to the requirements of a particular application.

A typical embodiment of the sensor shown in FIGS. 1 and 2 would utilize a flapper with a width of 2 inches, a diametrical clearance of 0.02 inch and a flapper mass of 3 grams. The average bias provided by the contact spring would be between 8 and 10 G's. This configuration achieves a desired response curve for a sensor where the sensor will marginally trigger on a 10 mile per hour crash.

Figure 3:
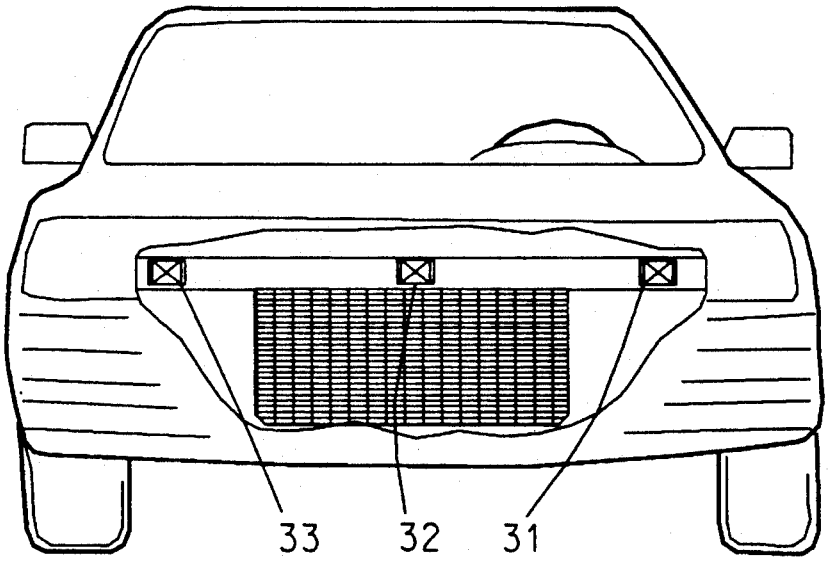
FIG. 3 shows a frontal view of a vehicle, illustrating the preferred mounting locations of frontal crush zone sensors.

The thin pancake shape of the sensor of this invention lends itself to be easily mounted in the preferred locations for sensing frontal impacts. This usually requires mounting within twelve inches from the front of the vehicle. However, for some small stiff cars, the crush zone only extends rearward about five inches at the time that sensor triggering is required. As shown in FIG. 3, these locations include the right and left sides of the radiator, 31 and 33, or some other suitable location which is in the proper geometric relationship to the front of the car so as to guarantee that at least one sensor will always be in the crush zone for air bag desired crashes. For some large cars, an additional sensor located on the center of the radiator 32 might also be required to catch direct centered impacts into poles, for example. These three sensors are electrically wired in parallel such that if any of these sensors triggers, deployment of the protection apparatus is initiated.

Figure 4:
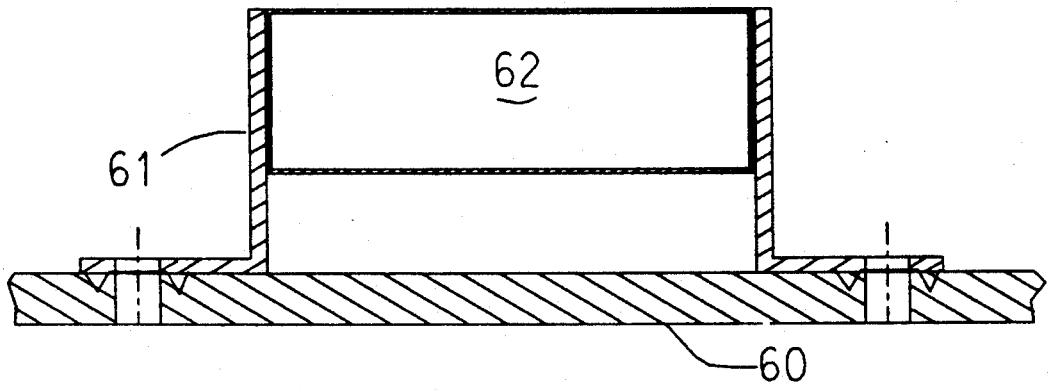
FIG. 4 is an elevated view of the sensor and preferred mounting structure to minimize the chance that the sensor will be rotated during a crash.
Figure 4A:
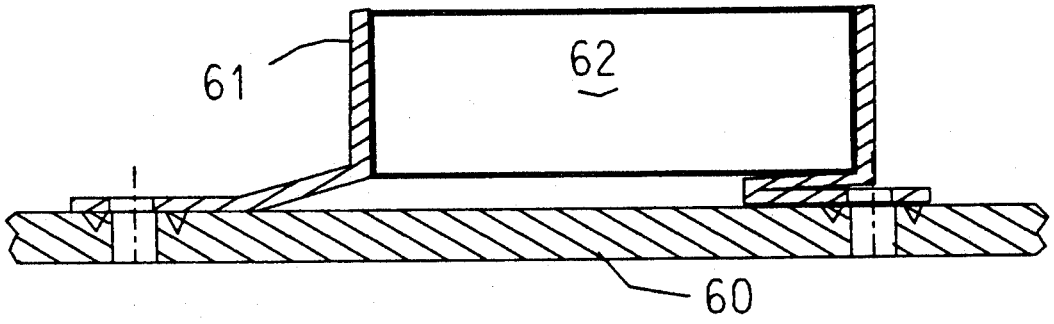
FIG. 4A is an elevated view of the sensor of FIG. 4 after the sensor has been deformed in a crash.
Figure 5:
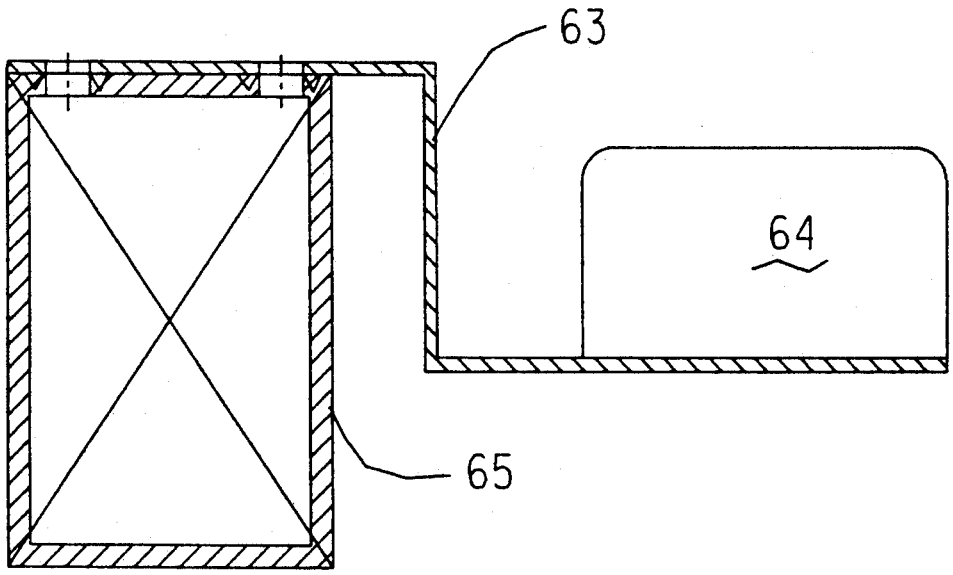
FIG. 5 is an elevated view of the standard ball-in-tube sensor showing its mounting structure.
Figure 5A:
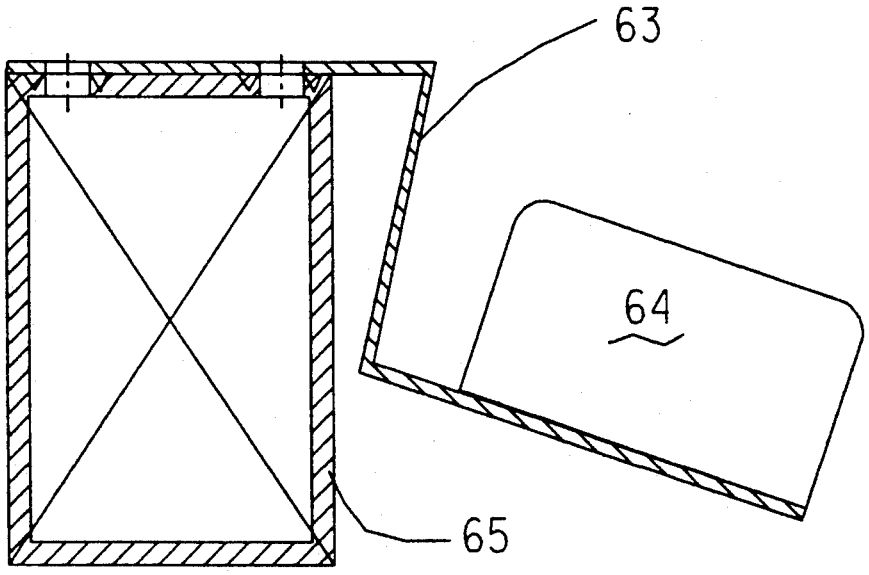
FIG. 5A is an elevated view of the sensor of FIG. 5 after the sensor has been deformed in a crash.

A preferred mounting structure is shown in FIG. 4. In this case the sensor is mounted to the radiator support 60 with four support brackets 61, (one at each corner). An offset impact to the sensor will cause these brackets to collapse displacing the sensor sideways but maintaining its forward orientation, as shown in FIG. 4A. In contrast, a typical mounting method used for the conventional ball-in-tube sensor is shown in FIG. 5 and the result of an off center impact between the crushed metal moving rearward during a crash and the sensor, shows, in FIG. 5A, the sensor rotated away from the forward direction. In this case sensor 64 is mounted on the radiator support 60 by means of L-shaped bracket 63. During a crash the sensor 64 rotates downward as shown in FIG. 5*a*.

Figure 6:
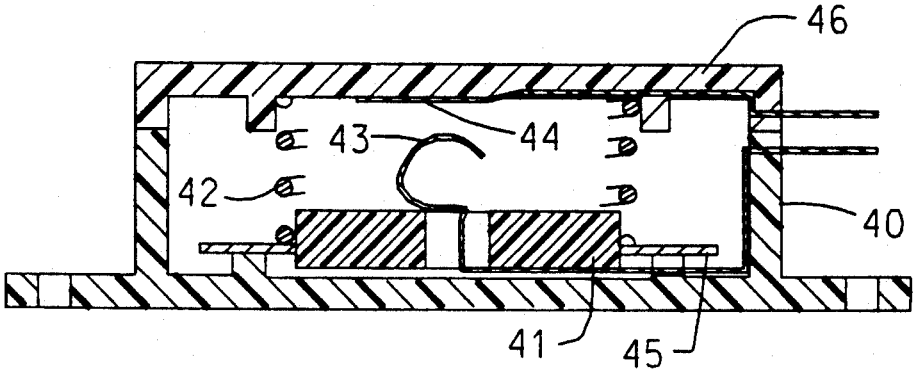
FIG. 6 is a transverse cross sectional view of a simple spring-mass sensor with a large cross section dimension and a relatively small thickness.

From the above discussion, a velocity sensing device is desirable, and inertially damped, velocity change sensors are the most suitable. Nevertheless, spring mass type sensors have the advantage of being simple and easier to implement, and if they are carefully placed in the crush zone at the proper distance form the front of the vehicle as taught in Breed U.S. Pat. No. 4,900,880, they will function properly in most cases. FIG. 6 is an example of a spring-mass sensor 40. It consists of a sensing mass 41, a biasing spring 42, and a pairs of contact 43 and 44. The sensing mass 41, mounted in disk 45, is held at an initial position by the biasing spring 42. In a crash, sensing mass 41 moves toward end 46 of the housing and closes contacts 43 and 44 if sensing mass 41 moves toward end 46 of the housing and closes contacts 43 and 44 if the crash pulse is of enough magnitude and duration.

Figure 7:
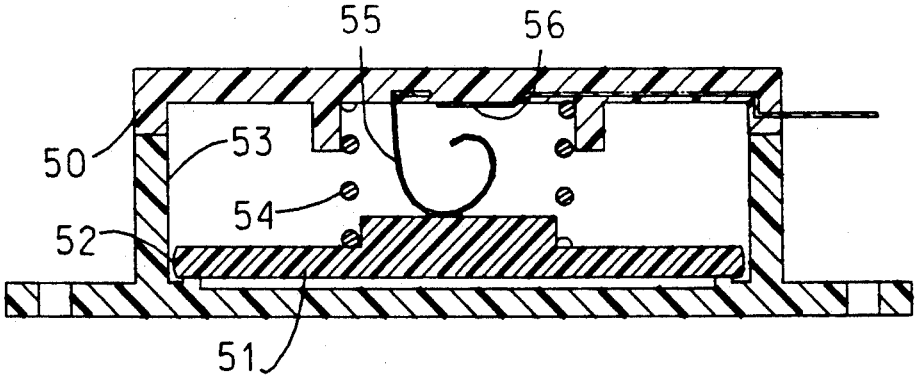
FIG. 7 is a transverse cross sectional view of a viscously damped disk sensor with a relatively large diameter and a short travel.

Similarly, FIG. 7 depicts a viscously damped sensor 50 adapted to be used for frontal impact sensing. A disk 51 with arc edge 52 is arranged to move in a cylinder 53. A spring 54 provides the biasing force. Contacts 55 and 56 will close an electrical circuit if the disk moves to a specified position. Due to the tight clearance and the large area on the arc edge, the flow through the clearance when the disk is moving is of the viscous type.

Such gas flow can provide a damping force linearly proportional to the velocity of the disk. The curved edges 52 of the disk permit it to rotate or roll about any contact point between it and the cylindrical housing 53. This design substantially eliminates the effects of sliding friction regardless of the direction of force. Since the disk is only a portion of a sphere, it is constrained from rotating about its transverse axes. This has the effect of substantially eliminating the adverse effects of cross axis accelerations which can cause the ball in conventional ball-in-tube sensors to rotate and whirl all of its principal inertial axes. The materials for the disk and cylinder must, of course, be chosen with different thermal expansion coefficients to compensate for the viscosity change of the gas with temperature as taught in the above referenced patents on ball-in-tube sensors.

Figure 8:
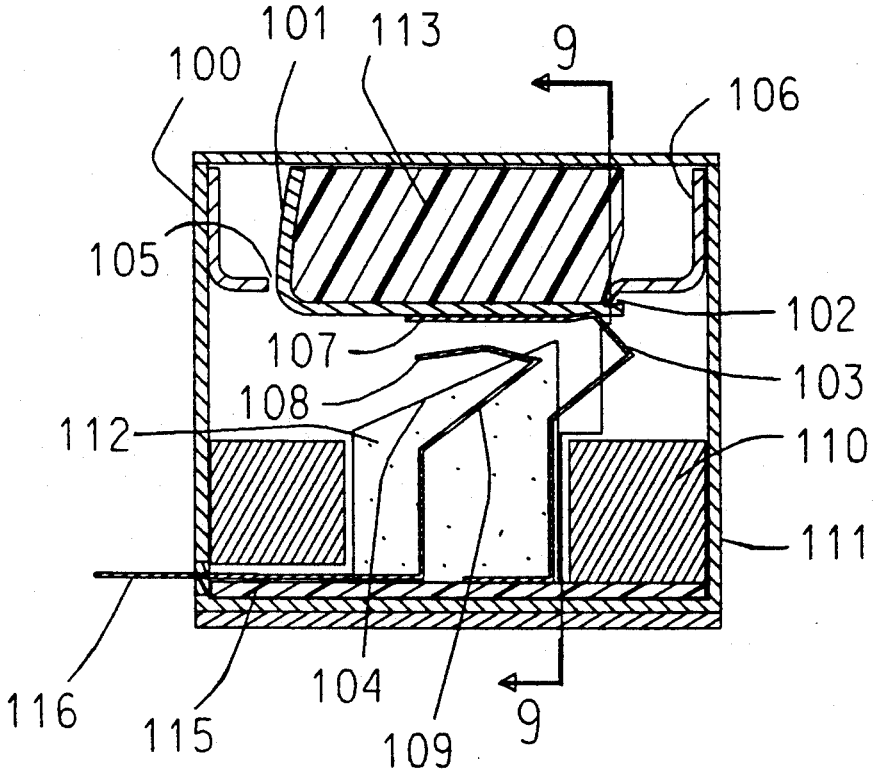
FIG. 8 is a transverse cross sectional view of another preferred embodiment of a testable frontal crush zone sensor having a rectangular metal housing.

FIG. 8 depicts an alternate preferred design of an inertial flow frontal impact crash sensor which is manufactured from metal and is testable. Some automobile manufacturers have a requirement that crash sensors be testable. At some time, usually during the start up sequence, an electronic circuit sends a signal to the sensor to close and determines that the contacts did close. In this manner, the sensor is operated and tested that it is functional. The testable sensor 100 of FIG. 8 consists of a metal flapper 101 which is hinged using a knife edge hinge 102. The flapper 101 is held against knife edge 102 by a contact and support spring 103 which exerts both a horizontal force and a bias moment onto the flapper. During operation, flapper 101 is acted upon by inertial forces associated with the crash and begins rotating around pivot 102. A small motion of the flapper however, expands the gas behind it creating a pressure drop which resists the motion of the flapper. This pressure drop is gradually relieved by the inertial flow of the gas through the clearance 105 between flapper 101 and orifice plate 106. If the crash is of sufficient severity, flapper 101 rotates until contact 107 of contact spring 103 contacts contact 108 of contact spring 109 and completes the electrical circuit initiating deployment of the occupant protective apparatus. Once contact is made, the flapper 101 can continue to rotate until it contacts with pole piece 104 for an additional amount sufficient to assure that the contact dwell is long enough to overlap with an arming sensor, if present, and provide enough current to ignite the squib which initiates the gas generator which, in turn, inflates the air bag. Flapper 101 can be filled with a plastic material 113 to control the volume of air trapped behind flapper 101. Contact springs 103 and 109 are attached to a printed circuit board 115 along with wires 116 which lead to other instrumentality.

Testing is achieved by applying a current, typically less than 2 amps, to the coil 110. When such a current is present, a magnetic circuit composed of the metal housing 111, pole 112, orifice plate 106 and flapper 101, leads the flux lines so as to create an attractive force between the pole 112 and the flapper 101 drawing the flapper into contact with the pole and causing contact 107 to contact contact 108 and complete the circuit.

Figure 9:
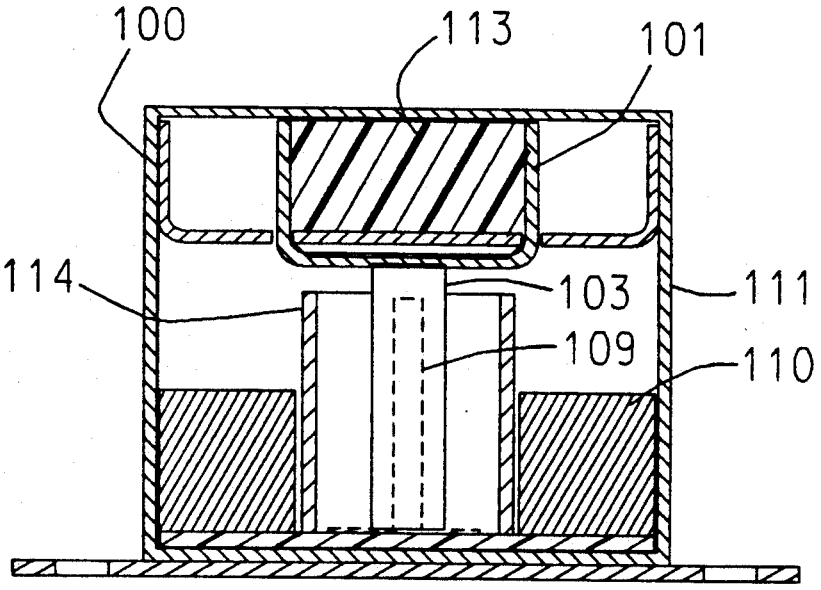
FIG. 9 is a transverse cross sectional view of the testable frontal impact sensor depicted in FIG. 8, viewed along 9—9.

FIG. 9 is a cross sectional view through the sensor of FIG. 8 along lines 9—9.

Figure 11:
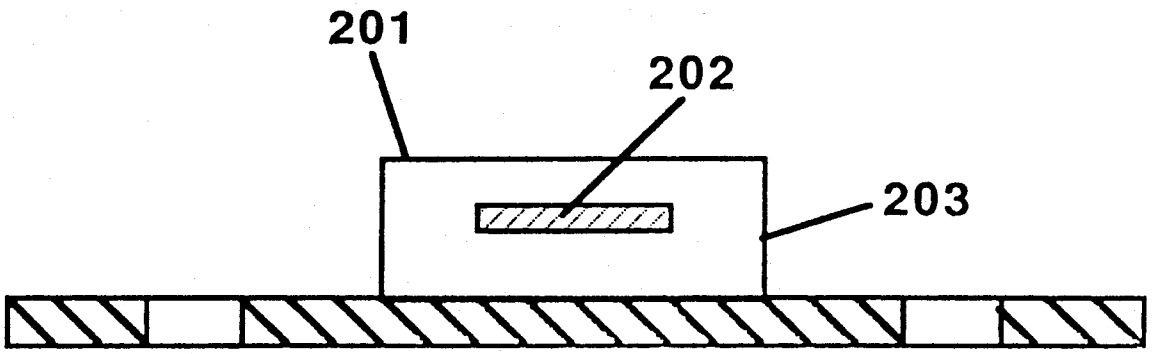
FIG. 11 is a transverse cross sectional conceptional view of an electronic frontal impact crush zone crash sensor.

FIG. 11 is a conceptional view of an electronic sensor assembly 201 built according to the teachings of this invention. This sensor contains a sensing mass 202 which moves relative to housing 203 is response to the acceleration of housing 203 which accompanies a frontal impact crash. The motion of sensing mass 202 can be sensed by a variety of technologies using, for example, optics, resistance change, capacitance change or magnetic reluctance change. Output from the sensing circuitry can be further processed to achieve a variety of sensor response characteristics as desired by the sensor designer.

Although the preferred application of the sensors described and illustrated in this disclosure is for sensing frontal impacts, the thin flat shape of these sensors makes them applicable for certain side impact sensing applications as described in copending patent application Ser. No. 07/480,273 filed on even date. Similarly, the low manufacturing cost and testable features makes some of the sensors described herein applicable for passenger compartment safing and discriminating applications as disclosed in copending patent application Ser. No. 07/480,271 also filed on even date.

Although several preferred embodiments are illustrated and described above, there are possible combinations using other geometries, materials and different dimensions of the components that can perform the same function. Therefore, this invention is not limited to the above embodiments and should be determined by the following claims.

I claim:

1. A frontal impact crash senior mounted in the crush zone of a vehicle for sensing crashes and deploying an occupant protection apparatus, comprising:

(a) a sealed housing, said housing formed from at least two members and containing a chamber therein, said housing having a thickness in the sensing direction less than both its height and width;

(b) a sensing mass within said housing chamber movable relative to said housing from a first at rest position to a second actuating position in response to a velocity change of said housing of sufficient magnitude to require the deployment of occupant protection apparatus;

(c) a narrow passageway between said sensing mass and said housing, said passageway substantially surrounding said sensing mass;

(d) damping means to dampen the motion of said sensing mass from said first at rest position to said actuating position, said damping means comprising the flow of a fluid through said passageway;

(e) biasing means within said housing to bias said sensing mass toward said first at rest position; and (f) means responsive to the motion of said mass to initiate an occupant protection apparatus.

2. The improvement sensor in accordance with claim 1, wherein said responsive means comprises a first contact means and a second contact means.

3. The improvement sensor in accordance with claim 2, wherein said first contact means engages and biases said sensing mass towards said first at rest position in said housing.

4. The improvement sensor in accordance with claim 1, wherein said mass and said housing are made of plastic.

5. The improvement sensor in accordance with claim 4, wherein said sensing mass and said housing each have at least one adjacent straight side and said sensing mass is attached to said housing by a hinge on said straight sides.

6. The improvement sensor in accordance with claim 5, wherein said hinge is made of plastic.

7. The sensor in accordance with claim 1, wherein said sensor is installed within twelve inches of the front of the vehicle.

8. The improvement sensor in accordance with claim 1, further comprising deformable mounting structure means attaches to said sensor, said mounting structure means providing a substantial resistance to the rotation of said sensor and thereby maintaining an orientation of said sensor pointed substantially forward as said mounting structure means deforms from a first pre crash position to a second post crash position.

9. The improvement sensor in accordance with claim i wherein said mass and said chamber have a substantially rectangular cross section in a plane perpendicular to the direction of motion of said sensing mass as it moves from said first position to said second position.

10. The improvement sensor in accordance with claim 1 wherein said sensing mass and said chamber have substantially circular cross sections in a plane perpendicular to the direction of motion of said sensing mass as it moves from said first position to said second position, thereby defining said passageway therebetween.

11. A frontal-impact sensor comprising:

(a) a sealed housing, said housing formed from at least two members and containing a chamber therein;

(b) a sensing mass within said chamber;

(c) support means within said housing to support said sensing mass, said support means permitting said sensing mass to rotate only about a single axis relative to said chamber;

(d) biasing means to bias said sensing mass to a first at rest position;

(e) response means responsive to the rotation of said sensing mass from said first at rest position to a second actuating position;

(f) a passageway between said sensing mass and said housing, said passageway substantially surrounding said sensing mass;

(g) damping means to dampen the motion of said sensing mass, said damping means comprising the flow of a fluid through said passageway.

12. The improvement sensor in accordance with claim 11, wherein said sensor is installed within 12 inches of the front of the vehicle.

13. The improvement sensor in accordance with claim 11 wherein said support means comprises a hinge attached to said sensing mass and said housing.

14. The improvement sensor in accordance with claim 11 wherein said support means comprises a mating knife edge and groove.

* * * * *